US011155104B2

(12) United States Patent
Yoda

(10) Patent No.: US 11,155,104 B2
(45) Date of Patent: Oct. 26, 2021

(54) MEDIUM HEATING DEVICE HAVING A SECOND HEATER FOR HEATING A REGION DOWNSTREAM OF A FIRST HEATER

(71) Applicant: SEIKO EPSON CORPORATION, Tokyo (JP)

(72) Inventor: Tomohiro Yoda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 14 days.

(21) Appl. No.: 16/778,358

(22) Filed: Jan. 31, 2020

(65) Prior Publication Data

US 2020/0247145 A1 Aug. 6, 2020

(30) Foreign Application Priority Data

Jan. 31, 2019 (JP) ..... JP2019-015286

(51) Int. Cl.
*B41J 11/00* (2006.01)

(52) U.S. Cl.
CPC ..... *B41J 11/002* (2013.01)

(58) Field of Classification Search
CPC ..... B41J 11/002; B41J 2/01
See application file for complete search history.

(56) References Cited

U.S. PATENT DOCUMENTS

| | | | |
|---|---|---|---|
| 6,354,015 B1 | 3/2002 | Ogasawara et al. | |
| 9,254,684 B2 | 2/2016 | Kitagishi et al. | |
| 2017/0217211 A1* | 8/2017 | Nakano | B41J 11/002 |

FOREIGN PATENT DOCUMENTS

| | | |
|---|---|---|
| JP | 2001-088276 | 4/2001 |
| JP | 2013-022750 | 2/2013 |

* cited by examiner

*Primary Examiner* — Bradley W Thies
(74) *Attorney, Agent, or Firm* — Workman Nydegger

(57) ABSTRACT

A medium heating device is provided, which is configured to heat a medium that is conveyed in a state where liquid is ejected onto the medium, and which includes: a support unit configured to support the medium that is conveyed in a state where the liquid is ejected onto the medium; a first heater configured to heat a first surface, of the medium, onto which the liquid ejected; and a second heater configured to heat a second surface of the medium opposite from the first surface. A region heated by the second heater includes a region downstream from a region facing the first heater.

6 Claims, 3 Drawing Sheets

MEDIUM HEATING DEVICE HAVING A SECOND HEATER FOR HEATING A REGION DOWNSTREAM OF A FIRST HEATER

The present application is based on, and claims priority from JP Application Serial Number 2019-015286, filed Jan. 31, 2019, the disclosure of which is hereby incorporated by reference herein in its entirety.

BACKGROUND

The present disclosure relates to a medium heating device and a liquid ejecting device.

JP-A-2001-88276 describes a medium heating device including a support unit that supports a conveyed medium onto which a liquid is ejected and a heater that heats, with radiant heat, a surface of the medium onto which the liquid is ejected.

SUMMARY

In order to dry the medium onto which the liquid is ejected, such medium heating device preferably heats the medium for a long time period at a high temperature falling within a range of not damaging the medium. Meanwhile, an area of a region heated by the heater is limited, and hence the heater needs to be increased in size in a direction of conveying the medium when a conveyance speed of the medium is higher. As a result, a range in which the medium is visually recognizable from an outside of the medium heating device is disadvantageously narrowed by the increased size amount of the heater. Particularly, the narrowed range in which the medium heated by the heater is visually recognizable may cause difficulty in grasping, from the outside, a drying condition of the medium onto which the liquid is ejected.

The present disclosure is directed to the above-described problem. A medium heating device, according to the present disclosure, includes a support unit configured to support a medium that is conveyed in a state where liquid is ejected onto the medium, the support unit having a support surface, a first heater configured to heat a first surface, of the medium, onto which the liquid ejected, and a second heater configured to heat a second surface of the medium opposite from the first surface, wherein a region heated by the second heater includes a region downstream from a region facing the first heater.

A liquid ejecting device, according to the present disclosure, includes a support unit configured to support a medium that is conveyed in a state where liquid is ejected onto the medium, the support unit having a support surface, a first heater configured to heat a first surface, of the medium, onto which the liquid ejected, and a second heater configured to heat a second surface of the medium opposite from the first surface, wherein a region heated by the second heater includes a region downstream from a region facing the first heater.

DESCRIPTION OF EXEMPLARY EMBODIMENTS

One embodiment of a liquid ejecting device including a medium heating device will be described below with reference to the drawings. The liquid ejecting device is, for example, an ink jet-type printer that records an image such as characters and photographs on a medium such as a sheet by ejecting ink, which is an example of a liquid.

Figure 1:
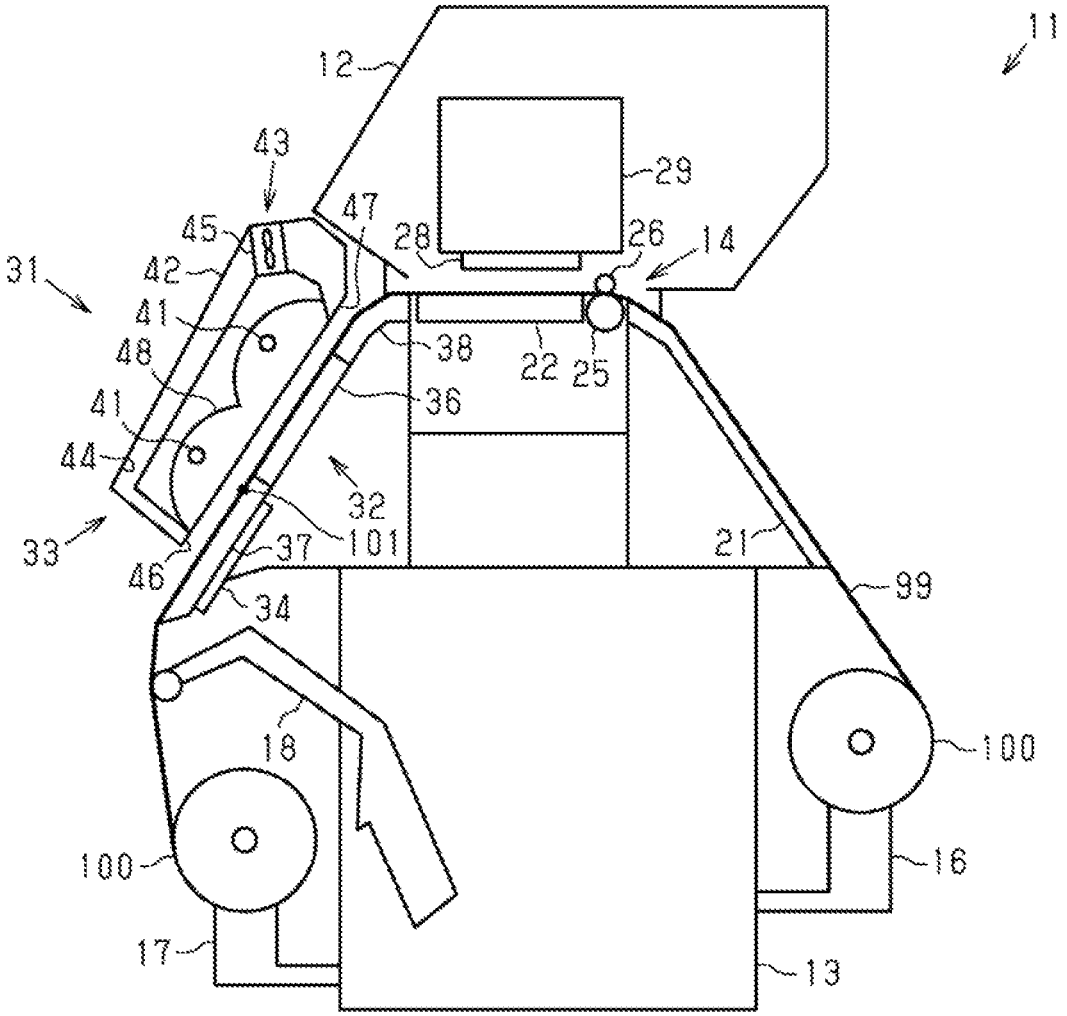
FIG. 1 is a side view schematically illustrating one embodiment of a liquid ejecting device including a medium heating device.

As illustrated in FIG. 1, a liquid ejecting device 11 includes an ejecting unit 28 that ejects a liquid onto a medium 99. the liquid ejecting device 11 includes a medium heating device 31 that heats the conveyed medium 99. The medium heating device 31 according to the present exemplary embodiment dries the medium 99 onto which the liquid is ejected from an ejecting unit 28.

The liquid ejecting device 11 includes a housing 12. The liquid ejecting device 11 includes a base 13 that supports the housing 12. In the present exemplary embodiment, the housing 12 is positioned above the base 13.

The liquid ejecting device 11 includes a conveyance unit 14 that conveys the medium 99. The conveyance unit 14 is provided in the housing 12. The conveyance unit 14 in the present exemplary embodiment conveys the medium 99 placed outside the housing 12.

The liquid ejecting device 11 may include a placement unit 16 on which a roll body 100 of the wound medium 99 is placed. The placement unit 16 may be attached to the base 13, for example. The placement unit 16 supports, in a rotatably manner, the roll body 100 of the wound medium 99 onto which liquid is not ejected. When the conveyance unit 14 is driven, the medium 99 is fed from the roll body 100.

Note that, the liquid ejecting device 11 may be configured to eject liquid onto the medium 99 fed from the roll body 100 placed on an installation surface on which the liquid ejecting device 11 is installed. Further, the liquid ejecting device 11 may be configured to eject liquid onto the medium 99 fed from a device other than the liquid ejecting device 11. The liquid ejecting device 11 is not limited to a configuration in which liquid is ejected onto the medium 99 fed from the roll body 100. For example, the liquid ejecting device 11 may be configured to eject the liquid onto the medium 99 that is elongated like fan-fold paper, or may be configured to eject the liquid onto a single sheet as the medium 99.

The liquid ejecting device 11 may include a winding unit 17 that winds the medium 99. The winding unit 17 may be attached to the base 13, for example. The winding unit 17 winds the medium 99 onto which the liquid is ejected as the roll body 100. Note that, the liquid ejecting device 11 may be configured to convey the medium 99 onto which liquid is ejected to a device other than the liquid ejecting device 11. The liquid ejecting device 11 may be configured to wind the medium 99 onto which the liquid is ejected on a device other than the liquid ejecting device 11.

The liquid ejecting device 11 may include a tension bar 18 that applies tension to the medium 99. The length of the medium 99 between the winding unit 17 and the conveyance unit 14 changes in accordance with a difference between a feeding amount of the medium 99 with the winding unit 17 and a feeding amount of the medium 99 with the conveyance unit 14. The tension bar 18 changes its position in accordance with a length of the medium 99 between the winding unit 17 and the conveyance unit 14. As described above, by changing the position of the tension bar 18 brought into contact with the medium 99, appropriate tension is applied to the medium 99. By applying tension to the medium 99 with the tension bar 18, the liquid ejecting device 11 is capable of ejecting the liquid onto the medium 99 accurately. The tension bar 18 in the present exemplary embodiment is brought into contact with a part of the medium 99, which passes through the medium heating device 31.

The tension bar 18 may be attached to the base 13, for example. The tension bar 18 attached to the base 13 in a manner allowing for its position to be changed. In this way, by changing the position of the tension bar 18, the amount of the tension applied to the medium 99 can be adjusted.

The liquid ejecting device 11 according to the present exemplary embodiment includes a first support portion 21 and a second support portion 22. The first support portion 21 and the second support portion 22 support the medium 99 conveyed by the conveyance unit 14. The first support portion 21 and the second support portion 22 are positioned in the order of the first support portion 21 and the second support portion 22 in a direction of conveying the medium 99. The second support portion 22 is positioned in the housing 12.

The ejecting unit 28 is positioned in the housing 12. The ejecting unit 28 in the present exemplary embodiment faces the second support portion 22. The ejecting unit 28 ejects the liquid onto a first surface of the medium 99, which is supported on the second support portion 22 and faces the ejecting unit 28.

The liquid ejecting device 11 in the present exemplary embodiment includes a carriage 29 on which the ejecting unit 28 is mounted. The carriage 29 scans the conveyed medium 99. In other words, the liquid ejecting device 11 according to the present exemplary embodiment is a serial printer in which the ejecting unit 28 scans the medium 99. The liquid ejecting device 11 may be a line printer in which the ejecting unit 28 is provided in an elongated manner in a width direction of the medium 99.

The conveyance unit 14 in the present exemplary includes a first roller 25 and a second roller 26. The first roller 25 and the second roller 26 convey the medium 99 by rotating while sandwiching the medium 99. The first roller 25 and the second roller 26 sandwich the medium 99 between the first support portion 21 and the second support portion 22.

Next, the medium heating device 31 will be described.

The medium heating device 31 includes a support unit 32 that supports the medium 99, a first heater 33 that faces the support unit 32, and a second heater 34 that is attached to the support unit 32. The support unit 32 in the present exemplary embodiment supports the medium 99 onto which the liquid is ejected with a support surface.

The support surface of the support unit 32 is a surface of the support unit 32 that faces the first heater 33. The first heater 33 is a radiation heater. The first heater 33 heats the medium 99 from the first surface of the medium 99 onto which the liquid is ejected. The second heater 34 heats the medium 99 from a second surface of the medium 99, which is a surface opposite to the first surface.

The support unit 32 includes a first support portion 36, a second support portion 37, and a third support portion 38. The second support portion 37 is positioned downstream from the first support portion 36 along a conveyance direction of the medium 99. The third support portion 38 is positioned upstream from the first support portion 36 along the conveyance direction of the medium 99. The second support portion 37 is positioned so that a part of the support surface exposes in the area downstream from the first heater 33. In other words, the first heater 33 does not cover a part including a downstream end of the second support portion 37. With this, the medium 99 supported on the second support portion 37 is visually recognizable. The second heater 34 is attached to a back surface of the second support portion 37. A heater is not attached to a back surface of the first support portion 36 or a back surface of the third support portion 38. Note that, in the present exemplary embodiment, a direction in which the medium 99 is conveyed through a conveyance path is referred to as a conveyance direction.

The third support portion 38, the first support portion 36, and the second support portion 37 are arrayed in the order of the third support portion 38, the first support portion 36, and the second support portion 37 along the conveyance direction of the medium 99. In the present exemplary embodiment, the third support portion 38 faces the first heater 33 at a part including a downstream end of the third support portion 38. A part including an upstream end of the third support portion 38 is positioned in the housing 12.

In the present exemplary embodiment, the first support portion 36, the second support portion 37, and the third support portion 38 are formed of, for example, an aluminum material or a SUS material. The aluminum material is a material regulated by JIS H 4000, for example. With this, uniformity of a temperature on the medium 99 and efficiency of heating the medium 99 with the second heater 34 can be improved.

The first heater 33 in the present exemplary embodiment includes heater pipes 41, a case 42, and a circulation unit 43. The heater pipes 41 heats the medium 99 supported on the support unit 32. The case 42 accommodates the heater pipes 41, and an opening of the case 42 is oriented to the support surface of the support unit 32. The circulation unit 43 circulates gas in the case 42.

The heater pipes 41 face the support surface of the support unit 32, which is a surface brought into contact with the medium 99. The heater pipes 41 are elongated in the width direction of the medium 99. The heater pipes 41 heat the medium 99 supported on the support unit 32 from the first surface, and dry the medium 99 onto which the liquid is ejected.

The first heater 33 in the present exemplary embodiment includes two heater pipes 41. The two heater pipes 41 have a posture in which the extending directions are parallel to each other. The extending directions of the two heater pipes 41 are parallel to the support surface of the support unit 32.

The circulation unit 43 includes a circulation path 44 through which gas flows, and a fan 45 positioned in the circulation path 44. The circulation path 44 is a flow path connecting an intake port 46 that introduces gas and a blowing port 47 that sends out gas. The circulation path 44 extends around the heaters 41. The intake port 46 faces the second support portion 37. The blowing port 47 faces the third support portion 38. The circulation unit 43 circulates gas, which is heated by the first heater 33 and the second heater 34, in the case 42, and promotes drying of the medium 99 onto which the liquid is ejected.

The medium heating device 31 may include a reflecting plate 48 that reflects heat output from the first heater 33 toward the support unit 32. A region heated by the first heater 33 is a region heated by light output from the heater pipes 41, and is larger than a region facing the first heater 33. With this, heat output from the first heater 33 can be conducted effectively to the medium 99 onto which the liquid is ejected.

Note that, the first heater 33 in the present exemplary embodiment includes the heater pipes 41 arranged to face the medium 99 supported on the support unit 32, and is only required to have a configuration of being capable of heating the medium 99 supported on the support unit 32 in a non-contact manner. For example, a configuration in which a heating unit is provided in the circulation path 44 so as to send gas heated by the heating unit toward the medium 99 may be adopted.

The second heater 34 in the present exemplary embodiment is a sheet-like heat generating element. The second heater 34 is attached to the back surface of the second support portion 37. Heat output from the second heater 34 is conducted to the medium 99 via the second support portion 37. With this, the medium 99 onto which the liquid is ejected is heated from the second surface.

In the medium heating device 31, a peak position 101 indicates a position at which the conveyed medium 99 has the highest temperature on the support surface of the support unit 32 due to heating of the first heater 33. The peak position 101 of the first heater 33 is a position at which the medium 99 has the highest temperature under a state in which the first heater 33 is not driven and the second heater 34 is driven.

The peak position 101 of the first heater 33 faces the first heater 33. In other words, the first heater 33 is positioned on a straight line being a straight line passing through the peak position 101 and a normal line of the medium 99 supported on the support unit 32. Under a state in which the first heater 33 is driven and the second heater 34 is not driven, a temperature at a target part being a part of the medium 99 rises from a time when the target part is conveyed onto the support surface and to a time when the target part arrives at the peak position 101 of the first heater 33. Further, the temperature at the target part of the medium 99 is lowered after the target part passes through the peak position 101.

For example, the peak position 101 of the first heater 33 is specified by conveying the dried medium 99, which includes a temperature sensor on its surface, at a constant speed. That is, the peak position 101 of the first heater 33 is specified based on a temperature detected by the temperature sensor included in the medium 99. In the present exemplary embodiment, the peak position 101 of the first heater 33 is specified based on the temperature detected by the temperature sensor when the medium 99 is conveyed at the lowest speed under a state in which the second heater 34 is not driven.

In the medium heating device 31, a drying condition of the medium 99 onto which the liquid is ejected is determined in accordance with a calorific amount input to the medium 99 and a time period for heating the medium 99. In order to dry the medium 99 quickly, the medium 99 is only required to be heated to a high temperature quickly. In order to heat the medium 99 to a high temperature quickly, a temperature on the support surface of the support unit 32 is only required to be increased. However, when the temperature of the medium 99 is excessively increased due to the high temperature on the support surface, there may be a risk of damaging the medium 99 with heat. In view of this, the medium heating device 31 preferably heats the medium 99 for a long time period at a high temperature falling within a range of not damaging the medium 99.

Meanwhile, an area of a region heated by the first heater 33 is limited, and hence the first heater 33 needs to be increased in size in the direction of conveying the medium 99 when a conveyance speed of the medium 99 is higher. A range from a downstream end of the first heater 33 to an upstream end of the winding unit 17 is a region in which the first surface of the medium 99 is visually recognizable from the outside, and hence a drying condition of the medium 99 onto which the liquid is ejected cannot be grasped easily from the outside when the first heater 33 is increased in size in the direction of conveying the medium 99.

Figure 2:
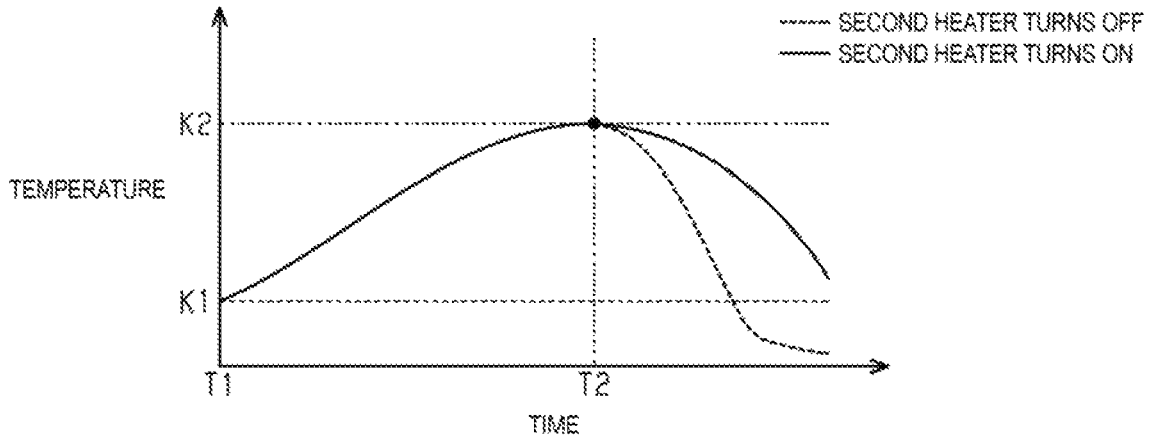
FIG. 2 is a graph showing temperature transition at a target part of a medium heated by a heater.

As illustrated in FIG. 2, an initial time at which a measured part of the medium 99 enters the region heated by the first heater 33 is referred to as a time T1. Further, an initial temperature of the measured part at the time T1 when the measured part enters the region heated by the first heater 33 is referred to as a temperature K1. The measured part of the medium 99 is a part of the medium 99 which is subjected to temperature measurement. The temperature K1 is a temperature of the measured part immediately after the measured part of the medium 99 passes below the ejecting unit 28.

The temperature of the measured part conveyed on the support unit 32 is increased as with passage of time from the time T1. The temperature of the measured part of the medium 99 is the highest at a time T2. That is, the measured part of the medium 99 arrives at the peak position 101 of the first heater 33 at the time T2. The measured part arriving at the peak position 101 of the first heater 33 is heated by the first heater 33, and has a temperature K2 being the highest temperature.

The temperature K2 is a temperature for promoting drying of the medium 99. In order to improve efficiency of frying of the medium 99, it is required to increase the temperature of the medium 99 quickly to the temperature K2. When the temperature of the medium 99 exceeds the temperature K2, there may be a risk of damaging the medium 99 with heat.

The measured part of the medium 99 after the time T2 enters the region heated by the second heater 34. The temperature of the measured part of the medium 99 heated by the second heater 34 is gradually lowered from the temperature K2. Meanwhile, under a state in which drive of the second heater 34 is stopped, the temperature of the measured part of the medium 99 is rapidly lowered from the temperature K2.

Figure 3:
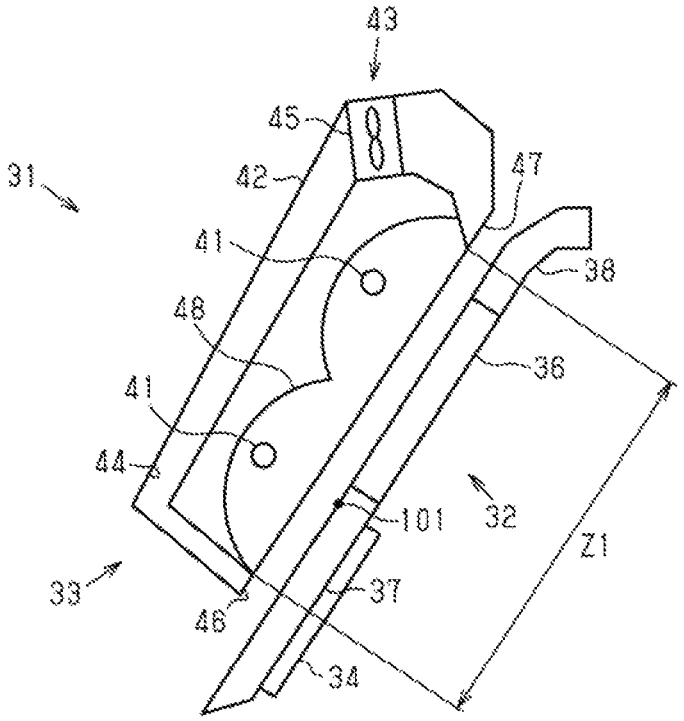
FIG. 3 is a partially enlarged view of the medium heating device illustrated in FIG. 1.

As illustrated in FIG. 3, the second support portion 37 includes a region downstream from a region Z1 facing the first heater 33. Note that, in the present exemplary embodiment, a state in which a certain region faces the first heater 33 indicates a state in which the first heater 33 is positioned on a straight line being a straight line passing through a freely-selected one point in the region and a normal line of the medium 99 supported on the second support portion 37. The region Z1 facing the first heater 33 is narrower than the region heated by the first heater 33 in the direction of conveying the medium 99.

In the present exemplary embodiment, a part including an upstream end of the second support portion 37 is positioned in the region Z1 facing the first heater 33. A part including a downstream end of the second support portion 37 is positioned downstream from the region facing the first heater 33. Further, the part including the upstream end of the second support portion 37 is positioned in the region heated by the first heater 33. The part including the downstream end of the second support portion 37 is positioned downstream from the region heated by the first heater 33.

The region heated by the second heater 34 is a sheet-like region occupied by the second heater 34 itself. In the present exemplary embodiment, a part including an upstream end of the region heated by the second heater 34 is positioned in the region facing the first heater 33. A part including a downstream end of the region heated by the second heater 34 is positioned downstream from the region Z1 facing the first heater 33.

Heat output from the second heater 34 is conducted to the medium 99 via the second support portion 37. The upstream end of the second support portion 37 is heater by the first heater 33 and the second heater 34. A temperature of a region facing the upstream end of the second support portion 37 is higher than a temperature of a region facing the first support portion 36 and a temperature of a region facing the third support portion 38.

The second heater 34 heats the medium 99 on a part of the region Z1 facing the first heater 33, and further heats the medium 99, from the second surface of the medium 99, on an area downstream from the region Z1 facing the first heater 33. Thus, a calorific amount input to the medium 99 is increased by a heating amount with the second heater 34 in the second surface. Further, the region heated by the second heater 34 is positioned downstream from the region Z1 facing the first heater 33, and hence the medium 99 that passes through the region facing the first heater 33 is further heated by the second heater 34. As a result, the temperature of the medium 99 heated by the first heater 33 is prevented from being lowered. Further, the medium 99 can be heated for a long time period and a drying condition of the medium 99 onto which the liquid is ejected can be visually recognized from the outside, which can be achieved in a compatible manner.

A heating setting-temperature for the first heater 33 is a temperature for setting an output amount of the first heater 33. The heating setting-temperature for the first heater 33 is a first heating setting-temperature, and is a temperature of the region facing the first heater 33. A heating setting-temperature for the second heater 34 is a temperature for setting an output amount of the second heater 34. The heating setting-temperature for the second heater 34 is a second heating setting-temperature, and is a temperature of the second heater 34. In the present exemplary embodiment, the first heating setting-temperature is higher than the second heating setting-temperature. With this, the liquid ejected onto the first surface can be quickly dried and hardened at a high temperature, and hence degradation of printing quality due to the ejected liquid spreading wetly on the first surface can be prevented.

The entire region heated by the second heater 34 is positioned downstream from the peak position 101 of the first heater 33. A calorific amount output from the second heater 34 further increases a calorific amount input to the medium 99, but may arise a risk of excessively increasing the temperature of the medium 99. With regard to this point, with a configuration in which the entire region heated by the second heater 34 is positioned downstream from the peak position of the first heater 33, the medium 99 that passes through the peak position 101 enters the region heated by the second heater 34. Thus, heating with the second heater 34 can lower a risk of excessive increase in temperature of the medium 99. Therefore, damage that the medium 99 receives from heating with the second heater 34 can be reduced.

Next, the functions and effects of the above-mentioned exemplary embodiment will be described.

(1) The second heater 34 heats the second surface being a surface opposite to the first surface of the medium 99. Thus, a calorific amount input to the medium 99 is increased by a heating amount with the second heater 34 in the second surface. In this case, the region heated by the second heater 34 is positioned downstream from the region Z1 facing the first heater 33, and hence the medium 99 that passes through the region Z1 facing the first heater 33 is further heated by the second heater 34. As a result, by heating with the second heater 34, the temperature of the medium 99 heated by the first heater 33 is prevented from being lowered. Therefore, the medium 99 can be heated for a long time period and a drying condition of the medium 99 onto which the liquid is ejected can be visually recognized from the outside, which can be achieved in a compatible manner.

(2) The first surface of the medium 99 is heated in the region at the first heating setting-temperature, and subsequently the second surface of the medium 99 is heated in the region at the second heating setting-temperature lower than the first heating setting-temperature. As a result, the liquid ejected onto the first surface can be quickly dried and hardened at a high temperature, and hence degradation of printing quality due to the ejected liquid spreading wetly on the first surface can be prevented. Further, the liquid dried at the first heating temperature can be fixed onto the medium 99 at a low temperature, and hence degradation of printing quality due to the hardened liquid peeling off from the medium can be prevented.

(3) The region of the support surface into which the medium 99 before heating is conveyed continuously is also a region in which the medium 99 at a low temperature absorbs heat continuously. When the first heating setting-temperature is higher than the second set temperature, temperature lowering due to continuous conveyance of the medium 99 can be prevented by heating with the first heater 33. Thus, the ejected liquid can be prevented more suitably from spreading wetly on the first surface.

(4) The medium 99 that passes through the peak position 101 enters the region heated by the second heater 34. Thus, heating with the second heater 34 can lower a risk of excessive increase in temperature of the medium 99. Therefore, damage that the medium 99 receives from heating with the second heater 34 can be reduced.

(5) The region heated by the second heater 34 overlaps the region heated by the first heater 33, and hence a risk of excessively lowering a temperature of the medium 99 heated by the first heater 33 can be lowered. That is, drying of the medium 99 by heating with the first heater 33 and fixation of the liquid by heating with the second heater 34 are performed as a series of processing having a mutual time overlap. As a result, heating efficiency of the medium heating device can be improved.

(6) The first heater 33 is a radiation heater, and hence the liquid ejected onto the first surface can be heated at a wide angle and in a wide range. As a result, degradation of printing quality such as wet spreading due to delay of drying in part of the liquid can be prevented.

The present exemplary embodiment may be modified as follows. The present exemplary embodiment and the modified examples thereof to be described below may be implemented in combination within a range in which a technical contradiction does not arise.

The entire region heated by the second heater 34 may be modified to be downstream from the region Z1 facing the first heater 33. According to the modified example, the region heated by the first heater 33 and the region heated by the second heater 34 overlap each other in a narrower area, and hence a risk of excessively increasing the temperature of the medium 99 can further be lowered. Therefore, a risk of damaging the medium 99 by heating with the second heater 34 can further be lowered.

Figure 4:
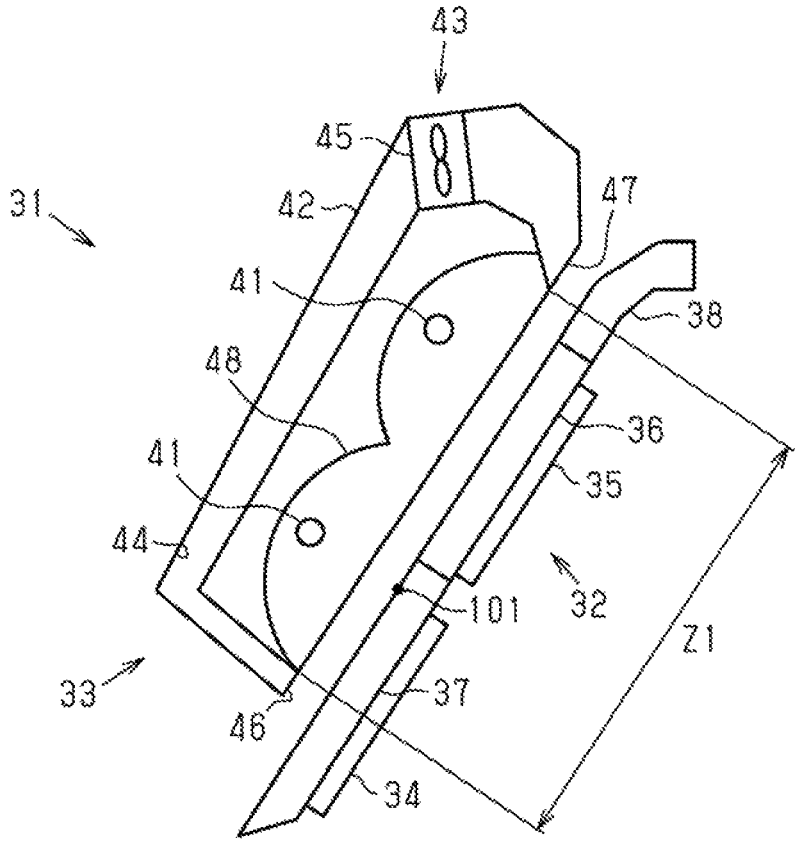
FIG. 4 is a side view schematically illustrating a modified example of the medium heating device.

The region heated by the second heater 34 may be modified to include the peak position 101 of the first heater 33. In this case, the region heated by the second heater 34 can further be modified to include a region upstream from the peak position 101 of the first heater 33. For example, as illustrated in FIG. 4, a change may be made so that another second heater 34 is attached to the back surface of the first support portion 36 and the region heated by the second heaters 34 and 35 include the peak position 101 of the first heater 33.

According to the modified example, hardening due to drying with the first heater 33 and fixation of the hardened liquid with the second heater 34 can be continuous in a wide range, which is suitable to a configuration using a liquid that is easily fixed onto the medium 99.

The region heated by the second heater 34 may be modified to a region occupied by the second support portion 37. The second support portion 37 is a collective region having high heat conductivity that enables heat to be conducted efficiently. Also in the modified example, the region heated by the second heater 34 includes the peak position of the first heater 33, and hence hardening of the liquid by drying with the first heater 33 and fixation of the hardened liquid onto the medium 99 with the second heater 34 can be continuous in a wide range. Further, the region heated by the second heater 34 can be expanded, and hence the medium 99 can be heated for a longer time period.

The medium 99 is not limited to a long paper fed from the roll body 100, and may be a single sheet. The medium 99 is not limited to paper, and may be fibers.

The liquid ejected by the ejecting unit 28 is not limited to ink, and may be, for example, a liquid material including particles of a functional material dispersed or mixed in liquid. For example, the ejecting unit 28 may eject a liquid material including a material such as an electrode material or a pixel material used in manufacture of a liquid crystal display, an electroluminescent display, and a surface emitting display in a dispersed or dissolved form.

Hereinafter, technical concepts and effects thereof that are understood from the above-described embodiments and modified examples will be described.

The medium heating device includes a support unit configured to support a medium that is conveyed in a state where liquid is ejected onto the medium, a support unit having a support surface, a first heater configured to heat a first surface, of the medium, onto which the liquid ejected, and a second heater configured to heat a second surface of the medium opposite from the first surface. The region heated by the second heater includes a region downstream from a region facing the first heater.

The liquid ejecting device includes a support unit configured to support a medium that is conveyed in a state where liquid is ejected onto the medium, the support unit having a support surface, a first heater configured to heat a first surface, of the medium, onto which the liquid ejected, and a second heater configured to heat a second surface of the medium opposite from the first surface. A region heated by the second heater includes a region downstream from the region facing the first heater.

According to each of the above-mentioned configurations, the second heater heats the second surface being a surface opposite to the first surface. Thus, a calorific amount input to the medium is increased by a heating amount of the second surface with the second heater. In this case, the region heated by the second heater is positioned downstream from the region facing the first heater, and hence the medium that passes through the region facing the first heater is further heated by the second heater. As a result, the temperature of the medium heated by the first heater is prevented from being lowered. Therefore, the medium onto which the liquid is ejected can be heated for a long time period and a drying condition of the medium onto which the liquid is ejected can be visually recognized from the outside, which can be achieved in a compatible manner.

In the medium heating device described above, a first heating setting-temperature, which is a heating setting-temperature for the first heater may be higher than a second heating setting-temperature, which is a heating setting-temperature for the second heater.

With this configuration, first, the first surface onto which the liquid is ejected is heated in the region at the first heating setting-temperature. Subsequently, the second surface of the medium heated in the region at the first heating setting-temperature is heated in the region at the second heating setting-temperature lower than the first heating setting-temperature. As a result, the liquid ejected onto the first surface can be quickly dried at a high temperature, and hence degradation of printing quality due to the ejected liquid spreading wetly on the first surface can be prevented. Further, the liquid dried in the region at the first heating setting-temperature can be fixed onto the medium in the region at the second heating setting-temperature, and hence degradation of printing quality due to the dried liquid peeling off from the medium can be prevented.

Further, the region of the support surface into which the medium before heating is conveyed continuously is also a region in which the medium at a low temperature absorbs heat continuously. When the first heating setting-temperature is higher the second set temperature, temperature lowering due to continuous conveyance of the medium can be prevented by heating with the first heater. Thus, the ejected liquid can be prevented more suitably from spreading wetly on the first surface.

In the medium heating device described above, the region heated by the second heater may be positioned downstream from a peak position of the first heater.

With this configuration, the medium that passes through the peak position enters the region heated by the second heater. Thus, heating with the second heater can lower a risk of excessive increase in temperature of the medium. Therefore, damage that the medium receives from heating with the second heater can be reduced.

In the medium heating device described above, the region heated by the second heater may overlap a region heated by the first heater.

With this configuration, the region heated by the second heater overlaps the region heated by the first heater, and hence a risk of excessively lowering a temperature of the medium heated by the first heater can be lowered. That is, drying of the liquid by heating with the first heater and fixation of the dried liquid by heating with the second heater are performed as a series of processing having a mutual time overlap. As a result, heating efficiency of the medium heating device can be improved.

In the medium heating device described above, the first heater may be a radiation heater.

With this configuration, the liquid ejected onto the first surface can be heated at a wide angle and in a wide range, and hence degradation of printing quality such as wet spreading due to delay of drying in part of the liquid can be prevented.

What is claimed is:

1. A medium heating device comprising:

a support unit configured to support a medium that is conveyed in a state where liquid is ejected onto the medium, the support unit having a support surface;

a first heater configured to heat a first surface, of the medium, onto which the liquid ejected; and a second heater configured to heat a second surface of the medium opposite from the first surface, wherein the support unit includes a first portion, a second portion, and a third portion, the first portion being in between the second and third portions in a transport direction of the medium and the second portion being downstream of the first portion in the transport direction, wherein the second heater is attached to the second portion of the support unit and is not attached to the first and third portions, and wherein a region heated by the second heater includes a region of the second portion of the support unit that is downstream in the transport direction from a region of the second portion of the support unit that is facing the first heater.

2. The medium heating device according to claim 1, wherein a first heating setting-temperature, which is a heating setting-temperature for the first heater, is higher than a second heating setting-temperature, which is a heating setting-temperature for the second heater.

3. The medium heating device according to claim 1, wherein the region of the second portion of the support unit heated by the second heater is positioned downstream from a peak position of the first heater.

4. The medium heating device according to claim 1, wherein the region of the second portion of the support unit heated by the second heater overlaps a region of the second portion of the support unit heated by the first heater.

5. The medium heating device according to claim 1, wherein the first heater is a radiation heater.

6. A liquid ejecting device comprising:

a support unit configured to support a medium that is conveyed in a state where liquid is ejected onto the medium, the support unit having a support surface;

a first heater configured to heat a first surface, of the medium, onto which the liquid ejected; and a second heater configured to heat a second surface of the medium opposite from the first surface, wherein the support unit includes a first portion, a second portion, and a third portion, the first portion being in between the second and third portions in a transport direction of the medium and the second portion being downstream of the first portion in the transport direction, wherein the second heater is attached to the second portion of the support unit and is not attached to the first and third portions, and wherein a region heated by the second heater includes a region of the second portion of the support unit that is downstream in the transport direction from a region of the second portion of the support unit that is facing the first heater.

* * * * *